US008438883B2

(12) United States Patent
Park et al.

(10) Patent No.: US 8,438,883 B2
(45) Date of Patent: May 14, 2013

(54) WASHING MACHINE IMPROVING WASHING EFFICIENCY

(75) Inventors: Jae Ryong Park, Hwaseong-si (KR); Sang Yeon Pyo, Suwon-si (KR); Sung Hoon Kim, Suwon-si (KR); Eun Suk Bang, Seoul (KR); Jee Hun Fark, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/587,247

(22) Filed: Aug. 16, 2012

(65) Prior Publication Data

US 2012/0304707 A1 Dec. 6, 2012

Related U.S. Application Data

(63) Continuation of application No. 11/984,215, filed on Nov. 14, 2007, now Pat. No. 8,266,931.

(30) Foreign Application Priority Data

Feb. 28, 2007 (KR) ..... 10-2007-0020506

(51) Int. Cl.
*D06F 21/00* (2006.01)
*D06F 23/00* (2006.01)
*D06F 25/00* (2006.01)

(52) U.S. Cl.
USPC ..... 68/142; 68/3 R

(58) Field of Classification Search ..... 68/142
See application file for complete search history.

(56) References Cited

U.S. PATENT DOCUMENTS

| | | | |
|---|---|---|---|
| 1,505,881 | A | 8/1924 | Fisher |
| 2,591,143 | A | 4/1952 | Eilersgaard |
| 2,904,962 | A | 9/1959 | Bochan |
| 5,887,470 | A | 3/1999 | Mirtsch |
| 5,934,110 | A | 8/1999 | Nitsche |
| 6,221,299 | B1 | 4/2001 | Mirtsch et al. |
| 6,334,341 | B1 | 1/2002 | Hellhake |

(Continued)

FOREIGN PATENT DOCUMENTS

| | | |
|---|---|---|
| DE | 278603 | 9/1914 |
| DE | 1 876 244 | 8/1963 |

(Continued)

OTHER PUBLICATIONS

Japanese Office Action for corresponding Japanese Patent Application No. 2007-327916 dated May 26, 2011.

(Continued)

*Primary Examiner* — Michael Barr
*Assistant Examiner* — Jason Ko
(74) *Attorney, Agent, or Firm* — Staas & Halsey LLP

(57) ABSTRACT

Disclosed herein is a washing machine that is capable of preventing the deformation of laundry due to spin-drying holes, increasing friction between the inner surface of a washing tub and laundry to improve the washing efficiency, and reducing wash water consumption. The washing machine includes a water tub, a washing tub mounted in the water tub, a drive unit to rotate the washing tub, and a wash water circulation unit to supply wash water in the water tub into the washing tub. The washing tub has a plurality of depressions formed therein and depressed outward from the inner surface thereof in the shape of a polygonal pyramid, and a plurality of spin-drying holes formed in a deep area of the respective depressions.

7 Claims, 5 Drawing Sheets

U.S. PATENT DOCUMENTS

| | | | |
|---|---|---|---|
| 6,584,811 | B2 | 7/2003 | Whah et al. |
| 2002/0023467 | A1 | 2/2002 | Seagar et al. |
| 2005/0015892 | A1 | 1/2005 | Park et al. |
| 2005/0097927 | A1 | 5/2005 | Kim et al. |
| 2010/0058589 | A1 | 3/2010 | Mirtsch et al. |

FOREIGN PATENT DOCUMENTS

| | | | |
|---|---|---|---|
| DE | 1 756 317 | | 4/1970 |
| DE | 6605248 | U | 5/1970 |
| DE | 66 06 902 | U | 12/1970 |
| DE | 1 958 076 | A1 | 5/1971 |
| DE | 23 63 935 | A1 | 7/1975 |
| DE | 28 26 506 | A1 | 1/1979 |
| DE | 41 31 005 | A1 | 6/1992 |
| DE | 43 11 978 | C1 | 4/1994 |
| DE | 44 37 986 | A1 | 4/1996 |
| DE | 44 45 669 | A1 | 6/1996 |
| DE | 196 03 710 | A1 | 8/1997 |
| DE | 196 51 295 | A1 | 6/1998 |
| DE | 297 05 226 | U1 | 7/1998 |
| DE | 297 08 914 | U1 | 9/1998 |
| DE | 197 50 576 | A1 | 6/1999 |
| DE | 199 54 027 | A1 | 6/2000 |
| DE | 199 51 743 | A1 | 5/2001 |
| DE | 100 21 456 | A1 | 11/2001 |
| DE | 101 45 079 | C1 | 10/2002 |
| DE | 10 2005 026 175 | A1 | 12/2006 |
| DE | 10 2005 041 516 | B4 | 11/2007 |
| DE | 10 2005 041 555 | B2 | 11/2007 |
| DE | 10 2006 029 951 | A1 | 1/2008 |
| DE | 10 2006 062 189 | B4 | 3/2009 |
| EP | 0 312 507 | A1 | 4/1989 |
| EP | 0 856 161 | A2 | 9/1996 |
| EP | 0 693 008 | B1 | 12/1997 |
| EP | 0 810 315 | A2 | 12/1997 |
| EP | 0 866 161 | A2 | 9/1998 |
| EP | 1 028 189 | A2 | 8/2000 |
| EP | 0 935 687 | B1 | 6/2001 |
| EP | 1 151 811 | A1 | 11/2001 |
| EP | 1 174 536 | A2 | 1/2002 |
| EP | 0 900 131 | B1 | 10/2002 |
| EP | 1 118 704 | B1 | 7/2003 |
| EP | 0 848 099 | B1 | 10/2003 |
| EP | 1 151 811 | B1 | 6/2005 |
| EP | 0 866 161 | A2 | 9/2005 |
| EP | 1 293 594 | B1 | 4/2006 |
| EP | 1 760 216 | A2 | 3/2007 |
| EP | 1925704 | A1 | 5/2008 |
| EP | 2 125 262 | B1 | 7/2010 |
| EP | 2 372 010 | A1 | 10/2011 |
| FR | 1038726 | A | 10/1953 |
| FR | 2 255 411 | | 7/1975 |
| GB | 2 006 836 | A | 5/1979 |
| JP | 48-20454 | | 6/1973 |
| JP | 6-335594 | A | 12/1994 |
| JP | 7-148389 | | 6/1995 |
| JP | 8-117485 | | 5/1996 |
| JP | 08-117485 | | 5/1996 |
| JP | 8-259381 | | 10/1996 |
| JP | 9-777 | | 1/1997 |
| JP | 09-000777 | | 1/1997 |
| JP | 11-137895 | | 5/1999 |
| JP | 11-300091 | A | 11/1999 |
| JP | 2001-218999 | A | 8/2001 |
| JP | 2002-80089 | | 3/2002 |
| JP | 2003-236295 | A | 8/2003 |
| JP | 2006-141985 | | 6/2006 |
| JP | 2006-141985 | A | 6/2006 |
| JP | 2007-68085 | | 3/2007 |
| JP | 2007-68087 | | 3/2007 |
| JP | 2010-513070 | | 4/2010 |
| KR | 1996-0004298 | | 5/1996 |
| KR | 2003-0004554 | | 1/2003 |
| KR | 10-2004-0067446 | | 7/2004 |
| KR | 10-2006-0107036 | | 10/2006 |
| WO | 98/20195 | | 5/1998 |
| WO | 00/02663 | | 1/2000 |
| WO | 02/085525 | A1 | 10/2002 |
| WO | 03/054275 | A1 | 7/2003 |
| WO | 2004/005603 | A1 | 1/2004 |
| WO | 2006/131416 | A1 | 12/2006 |
| WO | 2007/060455 | A2 | 5/2007 |

OTHER PUBLICATIONS

European Search Report dated Nov. 25, 2010 and issued in corresponding European Patent Application 07122278.0.

Japanese Office Action dated Dec. 18, 2009 corresponds to Japanese Patent Application No. 2007-327916.

Roppelt et al., Sep. 1998, EP0866161, English Machine Translation.

Koike et al., May 1996, JP 08-117485, English Machine Translation.

Russian Office Action issued Nov. 20, 2008 in corresponding Russian Patent Application 2007145043/12(049349).

U.S. Notice of Allowance mailed Jun. 7, 2012 in related U.S. Appl. No. 11/984,215.

U.S. Office Action mailed Mar. 20, 2012 in related U.S. Appl. No. 11/984,215.

U.S. Advisory Action mailed Nov. 7, 2011 in related U.S. Appl. No. 11/984,215.

U.S. Office Action mailed Jul. 13, 2011 in related U.S. Appl. No. 11/984,215.

U.S. Office Action mailed Mar. 22, 2011 in related U.S. Appl. No. 11/984,215.

U.S. Advisory Action mailed Dec. 14, 2010 in related U.S. Appl. No. 11/984,215.

U.S. Office Action mailed Oct. 8, 2010 in related U.S. Appl. No. 11/984,215.

U.S. Office Action mailed Jul. 14, 2010 in related U.S. Appl. No. 11/984,215.

WASHING MACHINE IMPROVING WASHING EFFICIENCY

CROSS-REFERENCE TO RELATED APPLICATIONS

This application is a continuation of U.S. application Ser. No. 11/984,215, filed Nov. 14, 2007, which claims the benefit of Korean Patent Application No. 2007-20506, filed on Feb. 28, 2007 in the Korean Intellectual Property Office, the disclosure of which is incorporated herein by reference.

BACKGROUND

1. Field

The present invention relates to a washing machine, and, more particularly, to a washing machine including a washing tub that is capable of decreasing the damage to laundry and improving the washing efficiency.

2. Description of the Related Art

Korean Patent Publication No. 2006-107036 discloses a washing machine including a drum-type washing tub rotatably mounted in a water tub. Inside the washing tub is mounted a plurality of lifters to lift and drop laundry during the rotation of the washing tub. In the circumference of the washing tub are formed a plurality of spin-drying holes to drain the water.

In this washing machine, the washing tub is rotated at high speed, while water in the water tub is drained during the spin-drying operation of the washing machine. With the high-speed rotation of the washing tub, laundry is brought into tight contact with the inner surface of the washing tub due to a centrifugal force, and water contained in the laundry is discharged through the spin-drying holes due to the centrifugal force.

As shown in FIG. 1, each spin-drying hole 2 formed in a washing tub 1 of such a washing machine is constructed in a conical shape whose diameter is gradually reduced from an inner surface to an outer surface of the washing tub 1. Each spin-drying hole 2 is deformed in a curved shape from an inner side to an outer side of the washing tub 1 with the result that each spin-drying hole 2 has a height h greater than the thickness of the washing tub 1. Each spin-drying hole 2 has a diameter of approximately 3.5 mm. Approximately 2000 spin-drying holes 2 are formed in the circumference of the washing tub 1. The size and number of the spin-drying holes 2 may be changed depending upon the washing tub 1.

When the spin-drying operation of the washing machine is operated at high speed, laundry 3 is brought into tight contact with the inner surface of the washing tub 1 due to a centrifugal force, as shown in FIG. 1. Consequently, when the laundry 3 is a soft material, portions of the laundry 3 adjacent to the spin-drying holes 2 may be introduced into the spin-drying holes 2 with the result that the laundry 3 becomes deformed. Specifically, a plurality of protrusions 3*a* may be formed at the surface of the laundry 3. This is because the portions of the laundry 3 adjacent to the spin-drying holes 2 are not supported, and the laundry 3 is deformed due to the flow of wash water drained out of the washing tub 1 through the spin-drying holes 2.

Also, the inner surface of the washing tub 1 is flat. Consequently, the friction between the inner surface of the washing tub 1 and the laundry is small during the washing operation of the washing machine, with the result that the washing efficiency due to the friction is limited.

Furthermore, it is necessary to supply wash water to the water tub such that the laundry 3 in the washing tub is immersed in the wash water during the washing operation of the washing machine. Consequently, the wash water consumption of the washing machine is large.

SUMMARY

Therefore, it is an aspect of the embodiments to provide a washing machine that is capable of preventing the deformation of laundry due to spin-drying holes.

It is another aspect of the embodiments to provide a washing machine that is capable of increasing the friction between an inner surface of a washing tub and laundry, during the washing operation of the washing machine, thereby improving the washing efficiency.

It is a further aspect of the embodiments to provide a washing machine that is capable of reducing wash water consumption.

Additional aspects and/or advantages will be set forth in part in the description which follows and, in part, will be apparent from the description, or may be learned by practice of the invention.

The foregoing and/or other aspects are achieved by providing a washing machine including a rotary washing tub, the washing tub including a plurality of depressions formed therein, and a plurality of spin-drying holes, the depressions are depressed outward from an inner surface of the rotary washing tub in a shape of a polygonal pyramid, the plurality of spin-drying holes being formed in a deep area of the respective depressions.

The depressions are arranged adjacent to each other.

Each of the depressions includes a polygonal side part protruding to the inner surface of the washing tub, valleys extending from corners of the polygonal side part to the corresponding spin-drying hole, and inclines extending from sides of the polygonal side part to the corresponding spin-drying hole.

The spin-drying hole may have a diameter of 2.2 to 2.6 mm, and the polygonal side part may have a diagonal length 16 to 18 times a depth of each of the depressions.

Each depression may be formed in a shape of a square pyramid having a square side part protruding closer to the inner surface of the rotary washing tub than the corresponding spin-drying hole.

Each side of the square side part may have a length 10 to 13 times greater than a depth of the corresponding depression.

The spin-drying hole may have a diameter of 2.2 to 2.6 mm, and each side of the square side part may have a length 10 to 13 times greater than a diameter of the corresponding spin-drying hole.

The foregoing and/or other aspects are achieved by providing a washing machine including a water tub including a plurality of depressions formed therein and depressed outward from the inner surface of the water tub in a shape of a polygonal pyramid, and a plurality of spin-drying holes formed in the respective depressions, a washing tub mounted in the water tub, a drive unit to rotate the washing tub, and a wash water circulation unit supplying wash water in the water tub into the washing tub.

The depressions are arranged adjacent to each other.

Each of the depressions includes a polygonal side part protruding to the inner surface of the washing tub, valleys extending from corners of the polygonal side part to the corresponding spin-drying hole, and inclines extending from sides of the polygonal side part to the corresponding spin-drying hole.

The spin-drying hole may have a diameter of 2.2 to 2.6 mm, and the polygonal side part may have a diagonal length 16 to 18 times a depth of the each of the depressions.

Each of the depressions may be formed in a shape of a square pyramid having a square side part protruding closer to the inner surface of the rotary washing tub than the corresponding spin-drying hole.

Each side of the square side part may have a length 10 to 13 times greater than a depth of the corresponding depression.

The square side part or the polygonal side part may be formed in the shape of a curved surface.

The spin-drying hole may have a diameter of 2.2 to 2.6 mm, and each side of the square side part may have a length 10 to 13 times greater than a diameter of the corresponding spin-drying hole.

The washing machine may further include a heater mounted at an inside bottom of the water tub to heat wash water.

The washing machine may further include a drainage unit draining water from the water tub and including a drainage pipe connected to a bottom of the water tub and a drainage pump connected to the drainage pipe.

The wash water circulation unit may include a flow channel switching valve mounted on the drainage pipe at an outlet of the drainage pump, a wash water circulation pipe extending from the flow channel switching valve to the inlet of the washing tub, and an injection nozzle coupled to an outlet of the wash water circulation pipe.

The foregoing and/or other aspects are achieved by providing a rotary washing tub having an inner surface housed within a washing machine, including: a plurality of sloping depressions formed along a surface of the rotary washing tub and sloping outwardly with respect to the inner surface of the rotary washing tub; and a plurality of spin-drying holes each formed within each of the depressions.

BRIEF DESCRIPTION OF THE DRAWINGS

These and/or other aspects and advantages will become apparent and more readily appreciated from the following description of the embodiments, taken in conjunction with the accompanying drawings, of which.

DETAILED DESCRIPTION OF THE EMBODIMENTS

Figure 1:
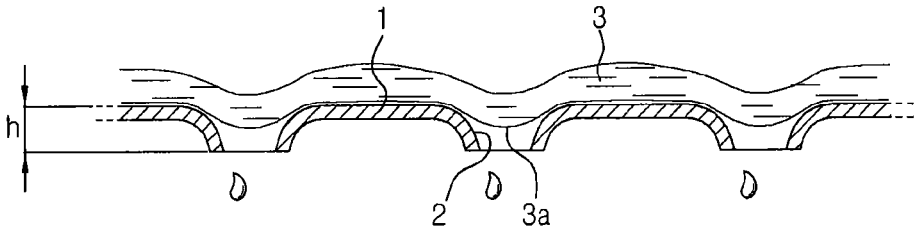
Fig. 1 (Prior Art)
FIG. 1 is a sectional view illustrating spin-drying holes formed in a washing tub of a conventional washing machine.

Reference will now be made in detail to the embodiments, examples of which are illustrated in the accompanying drawings, wherein like reference numerals refer to like elements throughout. The embodiment is described below to explain the present invention by referring to the figures.

Figure 2:
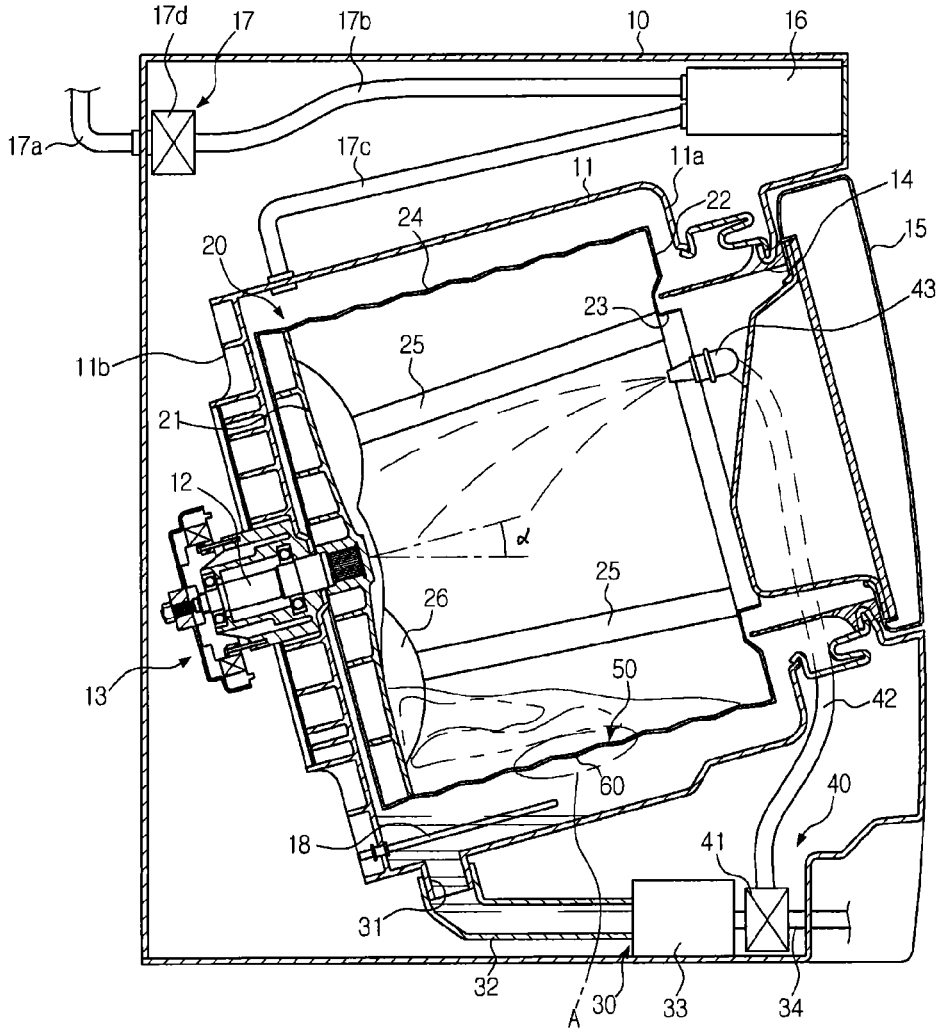
FIG. 2 is a sectional view illustrating the internal structure of a washing machine according to the present embodiment.

FIG. 2 is a sectional view illustrating an internal structure of a washing machine according to the present embodiment. The washing machine includes a machine body 10 having an inlet 14 formed in the front thereof such that laundry is inserted through the inlet 14, a water tub 11 mounted in the machine body 10, a drum-type washing tub 20 rotatably mounted in the water tub 11, and a door 15 to open and close the inlet 14 of machine body 10.

The water tub 11 is mounted at a predetermined angle a to the installation surface of the washing machine such that a front part 11*a*, having an inlet formed therein, is located at a higher position than a rear part 11*b*. The washing tub 20 is mounted in the same manner as the water tub 11.

The washing tub 20 is rotatably supported by a rotary shaft which is coupled to the rear part 21 of the washing tub 20 and extends through the rear part 11*b* of the water tub 11. Outside the rear part 11*b* of the water tub 11 is mounted a drive motor 13 to rotate the rotary shaft 12. As the rotary shaft 12 is rotated by the drive motor 13, the washing tub 20 is also rotated in the water tub 11.

Above the water tub 11 are mounted a detergent supply unit 16 to supply detergent into the water tub 11 and a water supply unit 17 to supply wash water into the water tub 11. The detergent supply unit 16 is mounted at the front of the machine body 10. The water supply unit 17 includes a first water supply pipe 17*b* connected between an external water supply pipe 17*a* and the detergent supply unit 16, a second water supply pipe 17*c* connected between the detergent supply unit 16 and the water tub 11, and a water supply control valve 17*d* mounted on the first water supply pipe 17*b* to control the supply of water. Consequently, water is supplied into the water tub via the detergent supply unit 16 such that detergent is supplied into the water tub together with the water.

At the inside bottom of the water tub 11 is mounted a heater 18 to heat wash water in the water tub 11. For the installation of the heater 18, a heater receiving part 11*c* is formed in the bottom of the water tub 11 such that the heater receiving part 11*c* protrudes downward. Consequently, the wash water is gathered in the heater receiving part 11*c* while the heater 18 is received in the heater receiving part 11*c*.

Below the water tub 11 are mounted a drainage unit 30 to drain the wash water in the water tub 11 and a wash water circulation unit 40 to supply the wash water in the water tub 11 into the washing tub 20. The drainage unit 30 includes a first drainage pipe 32 connected to a drainage port 31 formed in the bottom of the water tub 11, a drainage pump 33 mounted on the first drainage pipe 32, and a second drainage pipe 34 connected to the outlet of the drainage pump 33.

A wash water circulation unit 40 includes a flow channel switching valve 41 mounted on the second drainage pipe 34 at the outlet of the drainage pump 33, a wash water circulation pipe 42 extending from the flow channel switching valve 41 to the inlet 23 of the washing tub 20, and an injection nozzle 43 mounted at the outlet of the circulation pipe 42. The flow channel switching valve 41 serves to switch flow channels such that wash water from the outlet of the drainage pump 33 is drained to the outside or flows to the circulation pipe 42. The flow channel switching valve 41 may be an electric three-way valve, for example. Consequently, as shown in FIG. 2, when the drainage pump 33 is operated while the flow channel switching valve 41 is operated such that wash water flows to the circulation pipe 42, wash water in the water tub 11 is injected into the washing tub 20 through the first drainage pipe 32 and the circulation pipe 42. Also, when the drainage pump 33 is operated while the flow channel switching valve 41 is operated such that wash water flows to the second drainage pipe 34, through which the wash water is guided to the outside, wash water in the water tub 11 is drained to the outside.

Figure 3:
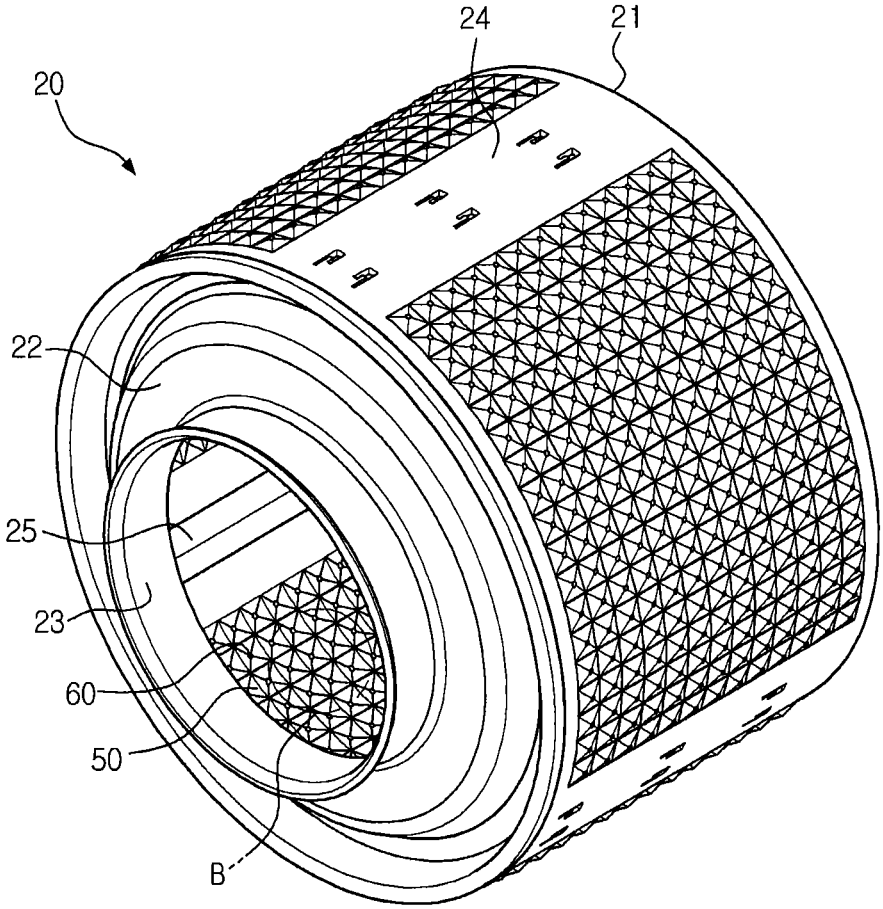
FIG. 3 is a perspective view illustrating a washing tub of the washing machine according to the present embodiment.

As shown in FIGS. 2 and 3, the washing tub 20 includes a rear part 21 coupled to the rotary shaft 12, a front part 22 having an inlet 23 formed therein, and a cylindrical circumference 24 coupled to the front part 22 and the rear part 21 at opposite ends thereof. Inside the circumference 24 of the washing tub 20 are mounted a plurality of lifters 25 to raise and drop laundry in the washing tub 20 during the rotation of the washing tub 20. Inside the rear part 21 of the washing tub 20 are formed a plurality of stirring protrusions 26 to increase a washing force.

Figure 4:
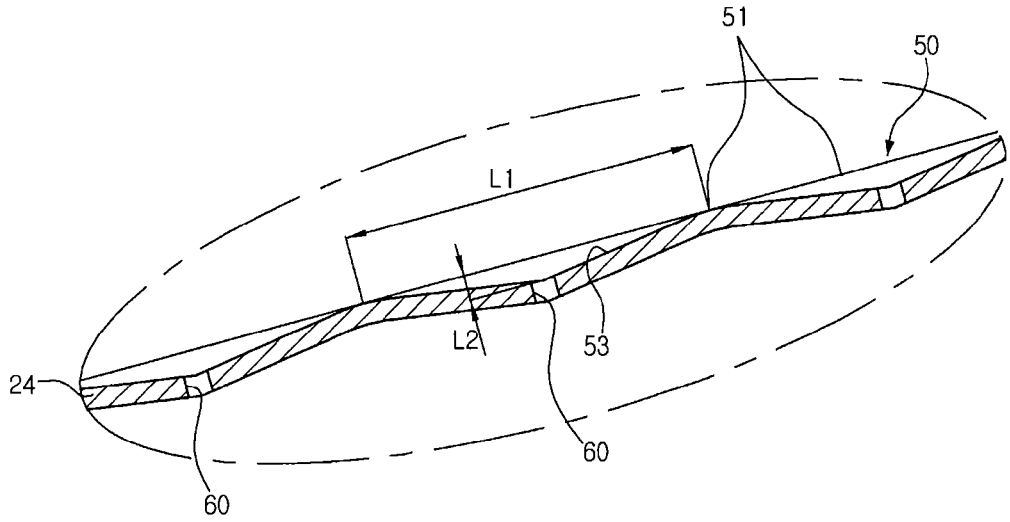
FIG. 4 is a detailed view illustrating part A of FIG. 2.
Figure 5:
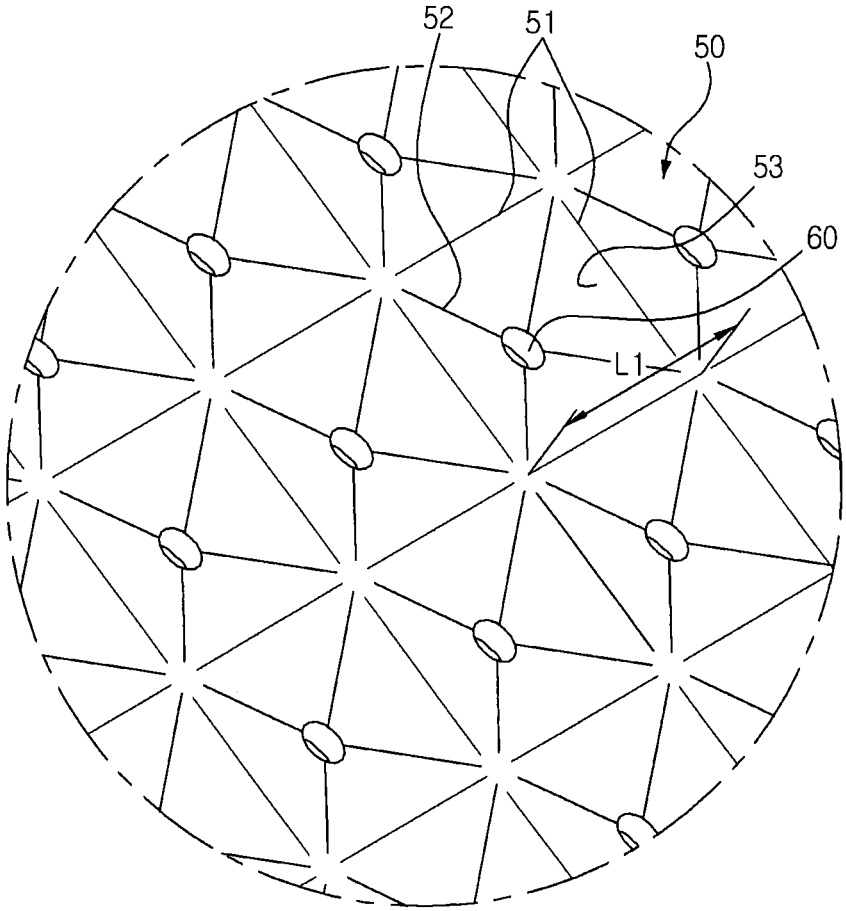
FIG. 5 is a detailed view illustrating part B of FIG. 3.

As shown in FIGS. 3, 4 and 5, a plurality of depressions 50 are formed in the circumference 24 of the washing tub 20 such that each depression 50 is depressed outward from the inner surface of the washing tub 20 in the shape of a square pyramid. A spin-drying hole 60 is formed in the deepest area of each depression 50 such that water is drained through the spin-drying hole 60. For effective drainage of wash water, each spin-drying hole 60 is generally located in the center of the corresponding depression 50. The spin-drying holes 60 are continuously arranged in all quarters of the depression 50. Consequently, square bent surfaces are continuously formed inside the circumference of the washing tub.

Each depression 50 includes a square side part 51 protruding closer to the inside of the circumference 24 of the washing tub 20 than the corresponding spin-drying hole 60, valleys 52 extending from the respective corners of the square side part 51 to the spin-drying hole 60, and inclines 53 extending from the respective sides of the square side part 51 to the spin-drying hole 60. The length L1 of each side of the square side part 51 may be set to be 10 to 13 times greater than the depth L2 of the depression 50 and 10 to 12 times greater than the diameter of the spin-drying hole 60, for example. In this case, the diameter of the spin-drying hole 60 may be set to be approximately 2.2 to 2.6 mm. Preferably, the length L1 of each side of the square side part 51 may be set to be 25 mm, the depth L2 of the depression 50 may be 2 mm, and the diameter of the spin-drying hole 60 may be 2.5 mm, for example.

With this construction, portions of laundry adjacent to the spin-drying holes 60 are dispersedly supported by the inclines 53 having a small inclination and a large area, when the washing tub 20 is rotated at a high speed to spin-dry the laundry. Therefore, the deformation of the laundry due to the spin-drying holes 60 is prevented.

As shown in FIG. 4, each square side part 51 protruding to the inside of the circumference 24 of the washing tub 20 is formed in the shape of a roundly curved surface. Consequently, the laundry is brought into contact with the roundly curved square side parts 51, and therefore, the deformation of and the damage to the laundry is prevented.

In this embodiment, the diameter of the spin-drying hole 60 is set to be 2.5 mm, for example, and the number of spin-drying holes 60 formed in the circumference 24 of the washing tub is set to be approximately 700. The diameter and number of the spin-drying holes 60 according to the present embodiment are generally less than those of the spin-drying holes according to the conventional art. Consequently, the deformation of laundry is prevented, and, during the washing operation of the washing machine, the drainage of wash water from the washing tub is delayed such that wash water for washing is contained in the washing tub 20. Specifically, when the water level of wash water supplied into the washing tub 20 by the wash water circulation unit 60 is below a predetermined water level, as shown in FIG. 2, the amount of wash water drained through the spin-drying holes 60 is controlled to be less than the amount of wash water supplied into the washing tub 20 such that the wash water is contained in the washing tub 20.

According to the present embodiment, when the water level in the washing tub 20 is lowered, the number of spin-drying holes 60 existing within the range of the water level is reduced, and therefore, the drainage of wash water from the washing tub 20 becomes slow. On the other hand, when the water level in the washing tub 20 is raised, the number of spin-drying holes 60 existing within the range of the water level is increased, and therefore, the drainage speed of wash water from the washing tub 20 becomes faster. Consequently, wash water is contained in the washing tub 20, and the water level of the wash water in the washing tub 20 is continuously properly maintained. According to the present embodiment, therefore, a sufficient wash water level is maintained in the washing tub 20, even when a small amount of wash water is supplied into the water tub 11, and thus the wash water consumption is reduced.

Furthermore, friction between the inner surface of the washing tub 20 and the laundry is increased by the depressions 50 during the washing operation of the washing machine, and thus the washing efficiency is improved.

Although FIGS. 4 and 5 illustrate that the depressions 50 are formed inside the washing tub 20 in the shape of a square pyramid, the depressions 50 may be formed in the shape of a polygonal pyramid. For example, the depressions 50 may be formed in the shape of a triangular pyramid, a pentagonal pyramid, a hexagonal pyramid, or any combination thereof. In any of these cases, the spin-drying holes 60 are formed in the deepest area of the respective depressions 50. When the depressions 50 are formed in the shape of a polygonal pyramid, such as a pentagonal pyramid or a hexagonal pyramid, the diameter of the spin-drying holes 60 may be preferably set to be 2.2 to 2.6 mm, for example, and the diagonal length of the polygonal side parts may be preferably set to be approximately 16 to 18 times the depth of the depressions 50, for example. In this case, the inclination of the inner surface of the depressions 50 is small, and therefore, the deformation of laundry is minimized during the spin-drying operation of the washing machine.

Hereinafter, the operation of the washing machine will be described.

When the washing machine is operated after laundry is put in the washing tub 20 and the detergent supply unit 16 is filled with detergent, the water supply control valve 17*d* of the water supply unit 17 is opened with the result that wash water is supplied into the water tub 11. Then, the detergent in the detergent supply unit 16 is supplied into the water tub 11 together with the wash water. After an appropriate amount of wash water is supplied, the water supply is terminated.

After the water is supplied, the washing tub 20 is rotated at low speed, by the operation of the drive motor 13, to perform washing. Also, the wash water contained in the lower part of the water tub 11 is supplied into the washing tub 20 by the operation of the wash water circulation unit 40. The amount of wash water supplied into the washing tub here 20 is less than the amount of wash water drained through the spin-drying holes 60, and therefore, an appropriate amount of wash water remains contained in the washing tub 20. When the water level in the washing tub 20 exceeds an appropriate water level, the number of spin-drying holes 60 existing within the range of the water level is increased. As a result, the drainage amount of water is increased, and therefore, the water level in the washing tub 20 is decreased. When the water level in the washing tub 20 is below the appropriate water level, the number of spin-drying holes 60 existing within the range of the water level is decreased. As a result, the drainage amount of water is decreased, and therefore, the water level in the washing tub 20 is increased. Consequently, the appropriate water level is constantly maintained in the washing tub 20.

According to the present embodiment, a predetermined amount of wash water remains contained in the washing tub 20 during the washing operation of the washing machine, and therefore, it is possible to perform effective washing even when a small amount of wash water is supplied into the water tub 11 and thus possible to reduce the wash water consumption. When the wash water is to be heated by the heater 18 such that laundry is washed using hot water, it is possible to rapidly heat the wash water since the amount of wash water is less than that of the conventional art. Thus, the total washing time is reduced, and the amount of energy necessary to heat the wash water is also reduced. Also, the friction between the inner surface of the washing tub 20 and the laundry is increased due to the depressions 50 formed inside the washing tub 20, and therefore, the washing efficiency is improved.

After the washing operation, a rinsing operation is performed. In the rinsing operation, spin-drying and water supply are repeated. After the rinsing operation, the washing tub 20 is rotated at a high speed to perform spin-drying. When the spin-drying operation is performed at high speed, the laundry in the washing tub 20 is brought into tight contact with the inner surface of the washing tub 20 due to a centrifugal force. In the washing tub 20 of the present embodiment, portions of the laundry adjacent to the spin-drying holes 60 are dispersedly supported by the inclines 53 of the depressions 50 that have a small inclination and a large area. Thus, the size of the spin-drying holes 60 is generally less than that of the conventional art. Consequently, the deformation of the laundry due to the spin-drying holes 60 is prevented.

As apparent from the above description, laundry in the washing tub, in which portions of the laundry are adjacent to the spin-drying holes, is dispersedly supported by the inclines of the depressions that have a small inclination and a large area. Thus, the size of the spin-drying holes formed in the washing tub is less than that of the conventional art. Consequently, the present embodiments have the effect of preventing the deformation of the laundry due to the spin-drying holes.

Also, friction between the inner surface of the washing tub and laundry is increased by the depressions arranged inside the washing tub. Consequently, the present embodiments have the effect of improving the washing efficiency.

Furthermore, a predetermined amount of wash water remains contained in the washing tub during the washing operation of the washing machine, and thus washing is effectively accomplished even when a small amount of wash water is supplied into the water tub. Consequently, the present embodiments have the effect of reducing the wash water consumption.

Although a few embodiments have been shown and described, it would be appreciated by those skilled in the art that changes may be made in this embodiment without departing from the principles and spirit of the invention, the scope of which is defined in the claims and their equivalents.

What is claimed is:

1. A washing machine, comprising:

a body;

a water tub installed in the body;

a drive motor installed at a rear part of the water tub to drive a rotary shaft; and a washing tub rotatably installed in the water tub, the washing tub including a cylindrical circumference having a plurality of lifter installation areas for lifters to be installed thereon, a front part disposed at a front of the cylindrical circumference and having an inlet for insertion of a laundry, and a rear part disposed at a rear of the cylindrical circumference and coupled to the rotary shaft, wherein the cylindrical circumference of the washing tub includes a pattern part formed between the plurality of lifter installation areas in a circumferential direction of the cylindrical circumference, and a plurality of spin-drying holes formed through the pattern part, the pattern part includes a plurality of depressions being depressed outward from an inner surface of the washing tub in a shape of a pyramid, the depressions each having a square base, and the depressions are arranged in a form of a matrix along the circumferential direction and a forward/backward direction of the cylindrical circumference, and the square bases of the depressions are connected to each other with respect to the circumferential direction and the forward/backward direction of the cylindrical circumference without having an offset.

2. The washing machine of claim 1, wherein the plurality of spin-drying holes are each formed at a center of each of the depressions.

3. The washing machine of claim 1, wherein each of the depressions comprises a square side part, and inclines extending from respective edges of the square side part, and the plurality of spin-drying holes is each formed at a portion at which at least two of the inclines meet each other.

4. The washing machine of claim 1, wherein the spin-drying holes are each formed in a deepest portion of the depressions.

5. The washing machine of claim 1, wherein the lifter installation areas are provided in a curved surface without having the depressions formed thereon.

6. The washing machine of claim 3, wherein the spin-drying hole has a diameter of about 2.2 mm to 2.6 mm.

7. The washing machine of claim 6, wherein one of the edges of the square side part has a length about 10 to 13 times the diameter of the spin-drying hole.

* * * * *

UNITED STATES PATENT AND TRADEMARK OFFICE

CERTIFICATE OF CORRECTION

PATENT NO. : 8,438,883 B2
APPLICATION NO. : 13/587247
DATED : May 14, 2013
INVENTOR(S) : Jae Ryong Park et al.

It is certified that error appears in the above-identified patent and that said Letters Patent is hereby corrected as shown below:

Title Page item [75] (Inventors), Line 4, Delete "Fark" and insert --Park--, therefor.

Signed and Sealed this
Eighth Day of October, 2013

Teresa Stanek Rea
*Deputy Director of the United States Patent and Trademark Office*